United States Patent [19]

Petersen, III

[11] 4,107,484

[45] Aug. 15, 1978

[54] SAFETY SWITCH

[75] Inventor: Carl Mogens Petersen, III, Pontiac, Mich.

[73] Assignee: Irvin Industries Inc., Stamford, Conn.

[21] Appl. No.: 816,747

[22] Filed: Jul. 18, 1977

[51] Int. Cl.[2] ..... H01H 27/06

[52] U.S. Cl. ..... 200/42 T; 200/44

[58] Field of Search ..... 200/42 R, 42 T, 44

[56] References Cited

U.S. PATENT DOCUMENTS

| | | | |
|---|---|---|---|
| 3,599,047 | 2/1971 | Magarian | 200/44 |
| 3,629,530 | 12/1971 | Fisher | 200/44 |
| 3,714,383 | 1/1973 | Leonard et al. | 200/42 T |
| 3,769,473 | 10/1973 | Lay | 200/44 |
| 3,816,677 | 6/1974 | Soltez | 200/42 T |

FOREIGN PATENT DOCUMENTS

| | | | |
|---|---|---|---|
| 1,092,523 | 4/1955 | France | 200/44 |

*Primary Examiner*—William Price
*Assistant Examiner*—Joseph M. Moy
*Attorney, Agent, or Firm*—McAulay, Fields, Fisher & Goldstein

[57] ABSTRACT

A safety on-off electrical switch for energizing an electrical apparatus. The safety switch is adapted to be mounted on the electrical apparatus, but may be separate therefrom. The safety switch includes a housing enclosing an on-off switch and an operating member, such as a key which is adapted for insertion into the housing to operate the on-off switch. The key has three different operative conditions relative to the housing. One is a key insertion and fully retraction position with no effect on the switch. The second is a neutral position in which the key is held in the housing, but cannot operate the switch; and the third is a switch operative position in which the key is movable from a fully inserted position to a partially retracted position to change the state of the switch from its off state to its on state.

6 Claims, 11 Drawing Figures

SAFETY SWITCH

BACKGROUND OF THE INVENTION

This invention relates in general to a safety switch and more particularly to the on-off toggle type of electrical switch which is used on a work bench or the like.

The accidental turning on of the main power switch at a work bench has frequently caused problems including fire, shock and injury. The intentional turning on of the switch by unauthorized individuals, and particularly by children, has caused the same problems. Accordingly, it is important that the switch be designed and housed so that turning it on requires a conscious deliberate act. It is further important that the switch be turned off in a fashion or in a mode which will make it very difficult if not impossible for a child or an unauthorized individual to turn on the switch.

A lock with a key can be used in conjunction with a switch in order to provide a desired degree of security. However, such arrangements are frequently cumbersome, expensive and inconvenient to use. Where cost is no major concern, a high degree of security can always be built into equipment. But as a practical matter if a secure switch is to be provided and used in a wide-range of circumstances and conditions the security feature must be simple in construction, convenient to use and inexpensive to provide. Accordingly, it is desirable that the safety device employ a few simple conventional parts.

The object of this invention is to provide all the above objectives and more particularly to provide a design in which there is an optimized tradeoff between cost, security, simplicity, fool proof operation and convenience of use.

BRIEF DESCRIPTION

In brief, the embodiment of the invention disclosed employs a key with a simple bit. The key shank and bit fit into the keyway of a housing within which a standard electrical switch is mounted. Access to the toggle member of the switch can be had only through use of the key and, in particular, the toggle of the switch can be actuated only by the bit of the key.

First and second opposed walls define the keyway. The first wall is tall enough so that when the key is fully inserted, the bit and wall block rotational movement of the key in a first rotational direction. The second wall is shortened sufficiently so that when the key is fully inserted the bit of the key clears the top edge of the wall and thus the key can be rotated in the second rotational direction. As the key rotates, the bit rides on the edge of the second and shorter wall until the key is rotated a full 180° at which point the key is aligned with the toggle of the electrical switch. The key is then pulled into a partially retracted position and in so doing the bit of the key will flip the toggle into its on state. When the key is pushed back, it flips the toggle into its off state and the key is returned to the position where it can be rotated back to permit withdrawing the key.

The key can be considered to have three positions. A first position is the insert position in which the key is fully inserted into the keyway. The third position is the operative position in which the key can be pulled and pushed to respectively turn the electric switch on and off. The second position is the range of rotational positions between the insert position and the operative position. This second position is called a neutral position herein.

A spring finger abuts against the end of the key when the key is inserted into the keyway and the finger has to be deflected slightly in order to permit the bit of the key to ride over the edge of the shorter of the two walls. Thus, in the neutral position the bit of the key is held between the edge of the shorter wall and the spring finger so that the key has a firm feel. In addition, there are two spaced apart small abutments extending up from the edge of the shorter wall. The bit of the key has to ride over one of these abutments when moving between its insert position and its neutral position and has to override a second of these abutments when moving between its operative position and its neutral position. The key thus has to be forced against the pressure of the spring in order to ride over these abutments and thus a user has a distinctive feel for each of these three key positons. The neutral position is useful in that it holds the key firmly in place so that it will not fall out of the keyway yet if the key is accidentally hit, the switch cannot be turned on. The requirement that the abutments be overridden means the user knows by feel when the key has been turned to its operative position and when the key has been turned to its neutral position.

DESCRIPTION OF THE PREFERRED EMBODIMENTS

The Structure

Figure 1:
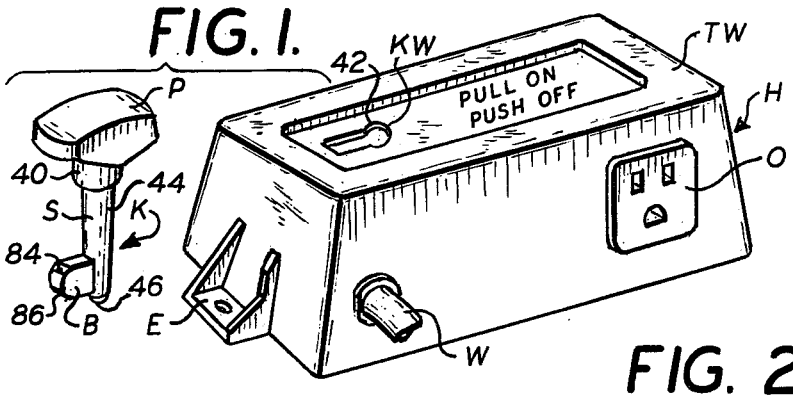
FIG. 1 is an overall perspective view of the housing enclosing the switch having three different positions of operation together with an operational key therefor.
Figure 2:
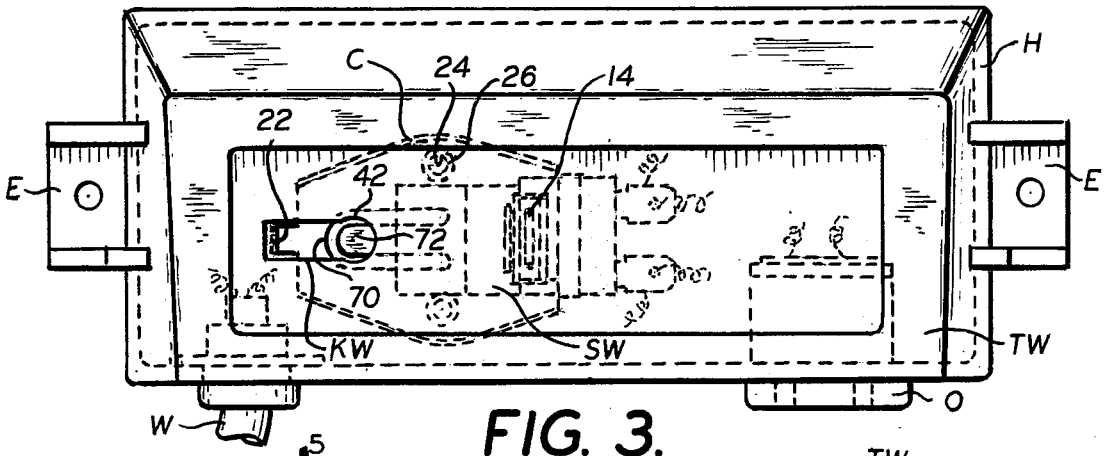
FIG. 2 is a top plan view of the switch housing of FIG. 1 showing the internal parts including the switch in dashed outline form.
Figure 3:
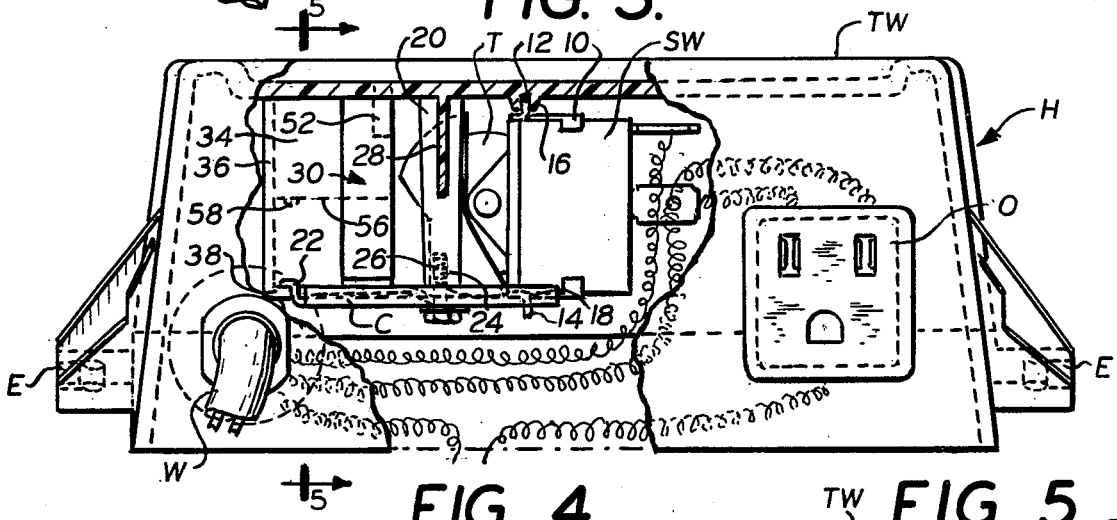
FIG. 3 is a side elevational view of the housing of FIG. 1 with a front wall broken away exposing the switch.
Figure 4:
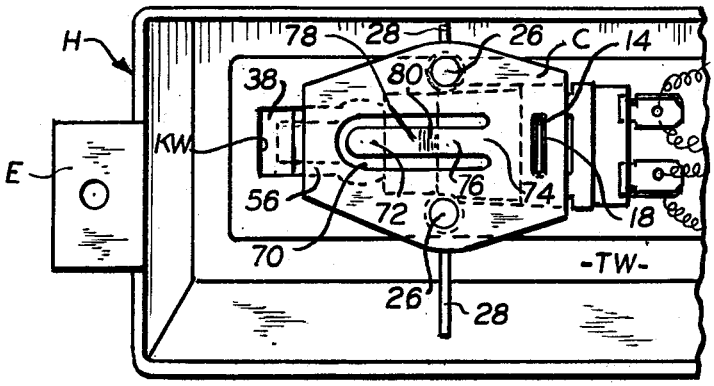
FIG. 4 is a partial bottom view looking into the bottom of the switch housing.
Figure 5:
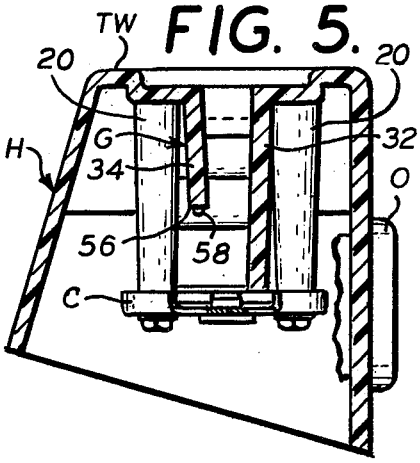
FIG. 5 is a sectional view taken along lines 5—5 of FIG. 3.

Referring now to the drawings, which illustrates a safety switch according to the invention, and in particular to FIG. 1, housing H is provided with a keyway KW which is adapted to receive a switch operating key K. Housing H has a trapezoidal configuration and has ear pieces E for attachment to a piece of machinery or other suitable surface. An electrical supply wire W which enters through one wall of the housing. The same wall of the housing contains a three-pronged outlet O. Outlet O may be used to connect another piece of equipment with the switch or to connect an indication light to indicate visually that the switch is in its "on" condition. The key K includes a pull-push or knob portion P connected with a shank portion S carrying an extending bit portion B at an end opposite to the knob portion. Keyway KW is configurated to receive shank portion S and bit B for insertion into housing H.

Referring now more particularly to FIGS. 2 to 5 of the drawing, switch SW is held to the interior of housing H by means of a connecting plate C so that the toggle T of switch SW is inaccessible through keyway KW. Supply wire W is connected with the prongs of switch SW and outlet O in a conventional manner.

Switch SW is provided with a bracket 10 having holding ears 12, 14. Housing H includes internally thereof U-shaped location member 16 having an oblong opening adapted to receive holding ear 12, and connection plate C is also provided with an oblong opening 18 to receive holding ear 14. Plate C is fixedly connected with the interior of housing H, and for this purpose, housing H has a pair of switch alignment posts 20 having an inner spacing sufficient to receive toggle T so as to permit normal longitudinal movement of toggle T and prevent any lateral movement of toggle T. Connecting plate C has a connection means for connection to housing H, and the connection means include an S-shaped portion 22 connected with housing H, in a manner to be explained hereinafter and openings 24 aligned with posts 20 and screws 26 which pass through openings 24 for connection with posts 20. Posts 20 are further held to housing H by means of reinforcement brackets 28.

Connected with keyway opening KW of housing H is a cylindrically-shaped key guide and positioning member G projecting internally from a top wall of housing H and positioned to align keyway bit B in operative association with toggle T.

Referring now additionally to FIGS. 6 to 11 together with FIGS. 1 to 5, key K is shown inserted into key guide and positioning member G through keyway KW and the three different positions which key K can assume in key guide G.

Key guide G includes an arcuate wall 30 configurated to complement key shaft S. Connected with arcuate wall 30 are a pair of spaced substantially parallel walls 32, 34, having a spacing therebetween slightly larger than the width of bit B or thickness of bit B. Shank S is shown in cross section as having a diameter larger than bit B. However, it is possible for the thickness of bit B and the diameter of shank S to have any relationship so long as the outer surface of shank S is arcuately shaped complementary to the inner circumference of arcuate wall 30. Connected to walls 32 and 34 is a transverse wall 36 opposite from arcuate wall 30. Connected with walls 34 and 36 is a projecting lip 38 extending in the direction of wall 30 and substantially parallel to the underside of top wall TW. Walls 32 and 36 are substantially the same length and perpendicular to each other and substantially equal in length to shank portion S.

Key K is provided with a shoulder portion 40 which connects shank portion S to knob portion P and is of a diameter larger than the circular portion of opening 42 of keyway KW to form cooperative bearing surfaces between the base of shoulder 40 and the top portion of housing H surrounding opening 42.

Shank portion S includes shank stem 44 and at the bottom thereof, a half-moon bearing surface or pivot 46. Bit B extends above bearing surface 46 and has its bottom surface co-extensive with the bottom of shank stem 44.

Arcuate wall 30 is formed from three partially circular-shaped wall segments 50, 52 and 54. Wall segment 50 extends from the underside of top wall TW approximately the length of shank stem 44 and is shortened from the length of wall 32 by the distance half-moon bearing surface 46 extends from the bottom of shank stem 44. Partially circular segment 52 (see FIGS. 9–11) which projects from the underside of top wall TW. The distance which segment 52 projects below the wall TW when added to twice the length of bit B equals the height of partially circular segment 50. Spaced wall 34 and partially circular segment 54 are connected together to form a continuous wall surface and together have a continuous flat surface 56 substantially parallel to the underside of top wall TW and is spaced from lip 38 by a distance equal to the length L of bit portion B. Projecting from the continuous flat surface 56 is a first abutment 58 carried by a wall 34 and a second abutment 60 carried by segment 54.

Connecting plate 6C includes a pair of spaced openings 62 which are aligned with openings 24 in switch alignment posts 20 through which screws 26 pass for holding connecting plate C to the posts 20. Opposite to oblong opening 18 is an offset connecting bracket member 62 having a first edge 64 co-planar with connecting plate C, a second edge 66 which is received under projecting lip 38 and offset 68 connecting first edge 64 with second edge 66. Projecting lip 38 together with offset 68, and connecting screws 26 together with alignment posts 20, hold switch SW in place in housing H. Plate C is provided with an elongated opening 70 having a spring-type tongue member 72 hinged at one end 74 to connecting plate C. Tongue 72 includes a hinge portion 76 and a spring-type portion 78 having a bearing surface forming a pivot portion for the half-moon bearing surface 46. Spring-type portion 78 is connected with hinge portion 76 be means of an offset 80, so that spring-type portion 78 is offset outside of the planar surface of connecting member C and projects towards the underside of top wall TW to urge key K in a direction outwardly of housing H and bit B into abutment with wall 34 or segment 54. Spring-type portion 78 together with pivot 46 cooperates with first and second abutments 58, 60 respectively to prevent rotation of the key when inserted into keyway KW unless pressure is exerted on the key so that bit B will override the abutments.

The outer contour of bit B is complementary to the surface 82 of toggle T. Bit B is also provided with lands 84 and 86 to exert pressure on outer portions 88 and 90, respectively of toggle T.

Because of the positioning of the toggle T offset from the keyway KW, a child using a screwdriver or the like cannot turn on the switch.

Operation

The safety switch has three different stages or positions and is substantially tamper-proof to unauthorized accessibility. Of course, access to the switch SW and its toggle T is possible by destroying housing H. However, short of destroying housing H, access to toggle T is not possible except by means of key K. For example, a screw-driver which may be inserted into keyway KW could not be used to move toggle T from one position to another position.

Figure 6:
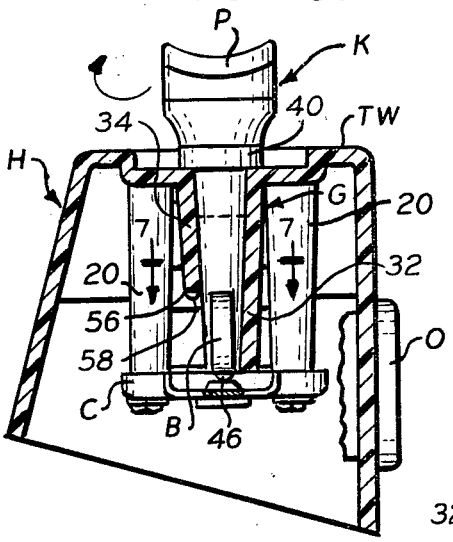
FIG. 6 is a sectional view similar to FIG. 5, but with the key inserted into the housing, illustrating a first operative position of the key.
Figure 8:
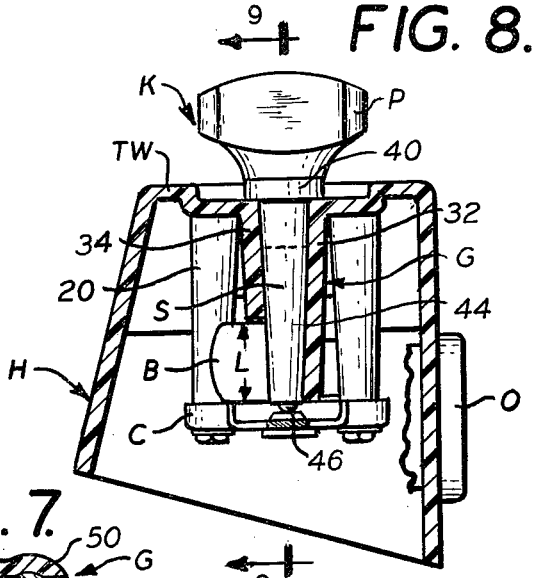
FIG. 8 is a sectional view similar to FIG. 6 with the key inserted and rotated 90° clockwise from its FIG. 6 position and with the bit located in a plane parallel to the plane of the drawing.
Figure 9:
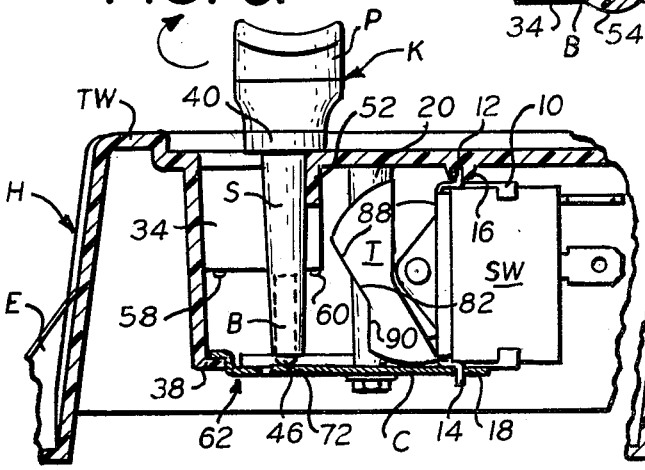
FIG. 9 is a partial transverse vertical sectional view with the key in the same position as shown in FIG. 8.
Figure 10:
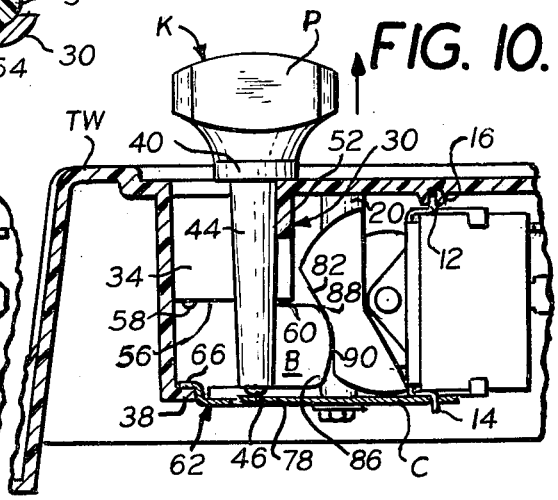
FIG. 10 is a sectional view similar to the sectional view of FIG. 9 with the key turned 90° clockwise into engagement with a toggle member of the switch. The key has been turned 180° from its FIG. 6 position, and the bit of the key is engaged with the toggle in the "off" condition or state of the switch; and, FIG. 11 is a sectional view similar to FIG. 10 showing the bit of the key engaged with the toggle of the switch and the key and toggle moved into the "on" condition or state of the switch.
Figure 11:
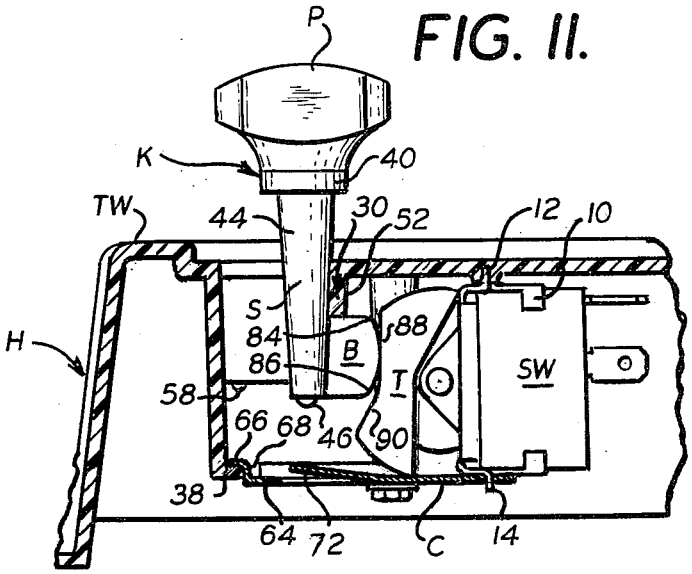

Key guide and positioning member G cooperates with keyway KW so that key K can be inserted into housing H in only one orientation with bit B axially aligned with the long axis of the housing H and with bit B facing in a direction opposite to toggle T. Therefore, insertion and removal of key K will not by itself operate toggle T. The insertion position for key K is shown in FIG. 6. The operative "off" position is shown in FIG. 10 and the operative "on" position is shown in FIG. 11. In the FIG. 6 position, wall 32 and bit B blocks rotation of the key in a first rotational direction. Wall 34 is shorter than wall 32 and thus does not block rotation in the second rotational direction. FIGS. 8 and 9 show the key in its neutral position. In the neutral position, the key cannot be removed from the housing H and cannot engage the toggle T.

It is necessary that deliberate action be taken to move the key from its FIG. 6 position which is the insertion position to its netural position. Deliberate action must also be taken to move the key from the FIGS. 8 and 9 neutral position to the operative - "off" position shown in FIG. 10. In the FIG. 10 position, the key can be moved from its fully inserted position to the FIG. 11 position which is a partially retracted position for the key.

Circular or arcuate wall 30 is composed of partially circular segments 50, 52 and 54. These segments 50, 52 and 54 are all of a different height. All of these segments extend vertically downwardly from the inside top portion of housing H and cooperate with keyway KW and spaced walls 32, 34 to assure proper orientation of key K and shank S upon insertion into housing H. These walls 30, 32 and 34 prevent the insertion of an implement such as a screw driver to move toggle T.

Shoulder 40 limits the extent to which key K can be inserted into keyway KW. In order to move the bit B from its FIGS. 6 and 7 position to its FIGS. 10 and 11 position, key K must be rotated 180° counterclockwise over the top edge of the wall 34 and must also override abutments 58, 60.

Figure 7:
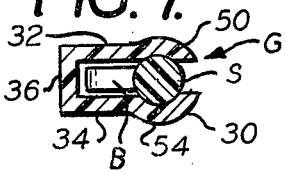
FIG. 7 is a sectional view taken along line 7—7 of FIG. 6 showing a detail of the key in its first operative position.

FIGS. 6 and 7 show the key in its insertion position. In order to move the key to its neutral position, the key is rotated so that the bit B will ride along the top edge 57 of wall 34 (see FIG. 8). In order to move the bit from its insertion position to its netural position, pressure must be exerted on the key against the spring finger 72 so that the bit can override the first abutment 58 on wall 34. The two abutments 58, 60 and the spring finger 72 cooperate to hold the bit B on the top edge 57 of the wall 34 and top edge of wall 54. Thus the bit is held in the neutral position and kept from engagement with the toggle T. To engage bit B with toggle T, it is necessary to exert pressure on the key against finger 72 and have the bit override second abutment 60. The key has now been rotated 90° from the center of its neutral position and 180° from its insertion position.

Partially circular segments 50 and 54 act as a guideway for shaft S. Shaft S moves vertically along its axis S—S. Land 84 engages the outer portion 88 to push the toggle T to its "on" position switching switch SW to its on state. When land 86 is engaged with outer portion 90, and the toggle T is pushed into its "off" position, switch SW is switched to its off state.

It will therefore be evident that if key K is left in its neutral position, it must be affirmatively moved and rotated to its operative - "off" position and then moved axially to its operative - "on" position switching switch SW to its on state.

What is claimed is:

1. A safety switch comprising:

a key having a bit, a housing having a stationary keyway and an on-off electrical switch mounted in said housing, said keyway being adapted to receive said key, said keyway having first and second opposed walls, said keyway providing an inserted position, intermediate rotational positions and an operative position, said second wall being substantially shorter than said first wall, said key when fully inserted in said inserted position being blocked from rotation in a first rotational direction by said first wall and free to rotate in a second rotational direction, said key when partially inserted into said inserted position being blocked from rotational movement by said first and said second walls, said key when fully inserted in said inserted position being free to rotate in said second rotational direction through a predetermined arc to said operative position, said key when in said operative position being free to move axially from said operative position to a partially retracted position, said switch having an operative switching member, said key when in said operative position being aligned with said operative switching member, axial retraction of said key to said partially retracted position when in said operative position, engaging said operative switching member to place said switch in an on state, a wall of said housing, engagement between said wall and said bit determining said partially retracted position, reinsertion of said key when in said partially retracted position causing said switch to switch into an off state, said bit of said key engaging an edge of said second wall in substantially all said intermediate rotational positions of said key between the initial fully inserted position and said operative position, said edge of said second wall preventing axial retraction movement of said key in said intermediate rotational positions.

2. The safety switch of claim 1 further comprising:

spring means mounted in said housing and engaging said key during said intermediate rotational of positions, said spring means biasing said key in an axially retracted direction, said key being held firmly between said spring means and said edge of said second wall during said intermediate rotational positions, first and second spaced abutments mounted on and extending axially from said edge of said second wall, said spring means deflecting sufficiently to permit said bit of said key to ride over said abutments, said abutments defining a neutral position for said key.

3. The safety switch of claim 1, wherein said keyway includes:

an arcuate wall connecting said first and said second walls, said arcuate wall having a channel aligned with said operative switching member, and said bit being guided in said channel when said key is in said operative position.

4. The safety switch as set forth in claim 3, including:

abutment means on one of said second wall, said abutment means including first and second abutments, one of said abutments being adjacent said arcuate wall and said other abutment being spaced from said one abutment.

5. The safety switch as set forth in claim 4, wherein:

said arcuate wall includes first and second arcuate segments and a third arcuate segment connecting said first and second segments;

said first and second segments forming a bearing for the shank portion of said key and forming said channel therebetween to align said bit with said switching member, to permit controlled rotation of said shank portion and axial movement of said shaft solely when said bit is aligned with said switching member.

6. The safety switch as set forth in claim 5, further comprising biasing means urging said bit into abutment with a top of said second wall and together with said first and second abutments tending to retain said key in said intermediate rotational positions.

* * * * *